US008570124B2

(12) United States Patent
Lee

(10) Patent No.: US 8,570,124 B2
(45) Date of Patent: Oct. 29, 2013

(54) STARTING SWITCH STRUCTURE

(75) Inventor: Mu-Hsien Lee, Taipei (TW)

(73) Assignee: Unipoint Electric Mfg. Co., Ltd., Taipei (TW)

( * ) Notice: Subject to any disclaimer, the term of this patent is extended or adjusted under 35 U.S.C. 154(b) by 0 days.

(21) Appl. No.: 13/483,777

(22) Filed: May 30, 2012

(65) Prior Publication Data

US 2013/0009730 A1 Jan. 10, 2013

Related U.S. Application Data

(60) Provisional application No. 61/492,816, filed on Jun. 3, 2011.

(51) Int. Cl.
*H01H 67/02* (2006.01)
*H01F 3/00* (2006.01)

(52) U.S. Cl.
USPC ..... 335/126; 335/131; 335/132; 335/238; 335/255; 335/256; 335/259; 335/279

(58) Field of Classification Search
USPC ..... 335/126, 238, 131, 255–256, 279, 132, 335/259
See application file for complete search history.

(56) References Cited

U.S. PATENT DOCUMENTS

| | | | | |
|---|---|---|---|---|
| 4,755,781 | A * | 7/1988 | Bogner | 335/131 |
| 4,825,180 | A * | 4/1989 | Miyaji | 335/131 |
| 7,038,564 | B1 * | 5/2006 | Kusumoto et al. | 335/126 |
| 8,305,168 | B2 * | 11/2012 | Cotič et al. | 335/126 |
| 2002/0005771 | A1 * | 1/2002 | Rhodes | 335/126 |
| 2011/0227676 | A1 * | 9/2011 | Cotic et al. | 335/188 |

FOREIGN PATENT DOCUMENTS

SI 20833 A * 7/2001

* cited by examiner

*Primary Examiner* — Mohamad Musleh
(74) *Attorney, Agent, or Firm* — Wang Law Firm, Inc.; Li K. Wang; Stephen Hsu

(57) ABSTRACT

A starting switch structure including a body, plunger piston movable in the body, wherein the plunger piston has a first accommodating portion at an end of the plunger piston for accommodating an end of a guide pin moving reciprocally, the accommodating portion has a butting portion at the bottom surface, an excitation portion wound around the end of the plunger piston, and a butting part at an open end of the accommodating portion of the plunger piston, wherein a contact point is led to electrically connect the first terminal to the second in case that the plunger piston and the guide pin move in a first direction when the excitation portion excites, while a broken circuit is led between the first terminal and the second terminal in case the plunger piston and guide pin move in a second direction after the excitation portion has finished exciting.

19 Claims, 12 Drawing Sheets

STARTING SWITCH STRUCTURE

CROSS-REFERENCE TO RELATED APPLICATION

This application is a non-provisional of U.S. Provisional Application No. 61/492,816 filed on Jun. 3, 2011, in the United States Patent and Trademark Office, the disclosure of which is incorporated herein in its entirety by reference.

BACKGROUND OF THE DISCLOSURE

1. Field of the Disclosure

The present invention relates to a starting switch structure, and more particularly, to a starting switch structure for a magnetic switch of a starter.

2. Brief Description of the Related Art

Currently, most people employ an automobile to move instead of walk, particularly when going to or off work or traveling on holidays. An automobile is more convenient than a bicycle, motorcycle or public transportation.

However, when an automobile starts to operate, the starter plays an important role to start operation of the automobile. If the starter is broken, the automobile cannot start and operate. Accordingly, the automobile can be deemed a useless device if the starter is broken. It is quite important to maintain the starter and to prevent the starter from being broken such that the automobile can remain functional. A magnetic switch of the starter has a starting switch structure functions to start the starter. When the starter, due to a key, receives a starting power, an electromagnetic force generated in the magnetic switch sucks a plunger piston of the starting switch structure such that a positive power pin of a battery can be connected. The starter has a common fault point that almost always is poor connection from ablation of a first contact point in the starting switch structure, due to being required to instantly connect over the long term, as shown in FIGS. 1 and 2. FIG. 1 shows a prior art 1; FIG. 2 shows a prior art 2.

In accordance with the above explanation, a starting switch structure of prior art has the following drawbacks:

1. In accordance with a starting switch structure of prior art 1, as shown in FIG. 1, a plunger piston 31 has an accommodating portion 311 at an end thereof such that a guide pin 30 can reciprocally move in the plunger piston 31. However, the guide pin 30 is separable from the plunger piston 31 such that the guide pin 30 has a contact point 301 subject to adhering to a terminal 32. Accordingly, the contact point 301 has poor connection such that the starting switch structure is not easy to start to operate and the starter would be burnt out due to running at idle.

1. In accordance with a starting switch structure of prior art 2 as shown in FIG. 2, an assembly includes a guide pin 40 and a plunger piston 41, wherein the guide pin 40 has an end reciprocally moving in an internal hole 411 extending along an axis of the plunger piston 41 and the other end having a contact point 401 for contacting and electrically connecting with a terminal 42. A shoulder 412 arranged for preventing the end of the guide pin 40 from separating from the plunger piston 41 is at an open end of the internal hole 411, wherein the shoulder 412 is integral with the plunger piston 41. The shoulder 412 is formed by processing an end of the plunger piston 41, however with a processing time that is too long such that the internal hole 411 is subject to inclination or counterboring and is not easy to be processed. This affects stability of the end of the guide pin 40 reciprocally moving therein.

Besides, in order for plunger piston 41 to butt against the guide pin 40 and move, is a butting part is arranged in a lateral direction relative to the axis. The butting part 50 is arranged in advance before a through hole 411 is manufactured from a side of the plunger piston 41. The plunger piston 41 is a cylinder and the process is performed on a large arc surface such that the through hole 411 is subject to offset or inclination. This affects stability of the butting part 50 butting against the guide pin 40. The yield is not easily controlled in mass production.

Besides, the butting part 50 is a cylinder and is butting against the guide pin 40, and thus a contact between the butting part 50 and the guide pin 40 is shaped in a line or area. The contact area is not enough to lead the guide pin 40 to be uniformly pressed when abutting against the plunger piston 41. When moving, the guide pin 40 is subject to vibration. This affects stability of the contact between the contact point 401 at the other end of the guide pin 40 and the terminal 42. When the contact point 401 contacts the terminal 42, a spark is easily generated and a melting corrosion happens at the contact point 401 after having been used in the long term. This leads the contact point 401 to be subject to adhering to the terminal 42.

Accordingly, in order to improve the above mentioned drawbacks, a starting switch structure providing a stable condition for an automobile when starting to operate which is also easy to fabricate should be developed.

SUMMARY OF THE DISCLOSURE

In order to improve the above-mentioned problems of prior art, the present invention is directed to a starting switch structure so as to solve the convention problems of adhesion between the first contact point and the second contact point and to improve process yield.

In accordance with an objective of the present invention, a starting switch structure is proposed including a body that is a hollow housing, a plunger piston movable in the body, wherein the plunger piston has a first accommodating portion at an end of an axis of the plunger piston for accommodating an end of a guide pin reciprocally moving therein, wherein the guide pin has a head at the end thereof and in the first accommodating portion, wherein the head has a planar surface at an end thereof close to a bottom surface of the first accommodating portion, wherein the first accommodating portion has a butting portion at the bottom surface thereof, wherein the butting portion has a planar surface configured to make surface-to-surface type contact with the head, wherein the guide pin has a contact point at the other end thereof and outside the body, an excitation portion wound in the body and around the end of the plunger piston arranged with the first accommodating portion, wherein the plunger piston and the guide pin move in a first direction when the excitation portion excites, while the plunger piston and the guide pin move in a second direction after the excitation portion has finished exciting, a butting part fixed at an open end of the first accommodating portion of the plunger piston, wherein a first through hole in the butting part receives the guide pin, and a cover that is a hollow housing receiving the body and covering the contact point, wherein a first terminal and a second terminal are arranged corresponding to the contact point, wherein the contact point is led to contact the first and second terminals and thus electrically connect the first terminal to the second terminal in case that the plunger piston and the guide pin move in the first direction, while the contact point is led to separate from the first and second terminals such that a broken circuit exists between the first terminal and the second terminal in case that the plunger piston and the guide pin move in the second direction.

In accordance with an embodiment, the starting switch structure further comprises a pedestal in the body and at an end of the body apart from the plunger piston, wherein when the excitation portion excites, the plunger piston is led to be sucked in the first direction such that the contact point contacts the first and second terminals at the time when a secondary clearance exists between the plunger piston and the pedestal, and then the plunger piston contacts the pedestal.

In accordance with an embodiment, the butting portion butts against the guide pin so as to prevent the guide pin from moving in the first direction after the secondary clearance exists.

In accordance with an embodiment, the first accommodating portion has a size corresponding to that of the head.

In accordance with an embodiment, the plunger piston has a second accommodating portion at the other end of the axis for accommodating an end of a plunger piston rod, wherein the plunger piston rod is fixed with the second accommodating portion by a first fixing part.

In accordance with an embodiment, the starting switch structure further comprises a first spring fitting around the plunger piston rod, wherein the plunger piston rod has a second fixing part at the other end thereof, wherein the first spring has an end against the body and the other end against the second fixing part.

In accordance with an embodiment, the starting switch structure further comprises a second spring having an end at the contact point and at a different side from the first accommodating portion and the other end against a bottom surface of the cover.

In accordance with an embodiment, the butting part has a planar surface at a side thereof in the first accommodating portion.

In accordance with an embodiment, the butting part is fixed at the open end of the first accommodating portion by tight fitting, locking or screwing.

In accordance with an objective of the present invention, a starting switch structure is proposed to be suitable for electrical connection of a contact point to first and second terminals. The starting switch structure includes an excitation portion receiving a current to excite, a plunger piston excited by the excitation portion, wherein the plunger piston has a first accommodating portion at an end of an axis of the plunger piston, wherein the first accommodating portion has a butting portion at a bottom surface thereof, wherein the butting portion has a planar surface, wherein the first accommodating portion receives an end of a guide pin reciprocally moving therein, wherein the guide pin is excited by the excitation portion and has a head at the end thereof, wherein the head has a planar bottom surface at a side thereof close to a bottom surface of the first accommodating portion such that the butting portion makes surface-to-surface type contact with the head, wherein the contact point is arranged at the other end of the guide pin and outside the starting switch structure, wherein the contact point is led to be electrically connected to the first and second terminals in case that the plunger piston and the guide pin move in a first direction, while a broken circuit is led between the first terminal and the second terminal in case that the plunger piston and the guide pin move in a second direction, and a butting part fixed at an open end of the first accommodating portion of the plunger piston.

In accordance with an embodiment, the head of the guide pin is constrained in the first accommodating portion by the butting part and the bottom surface of the first accommodating portion of the plunger piston.

In accordance with an embodiment, the butting part has a planar surface at a side of an inner space of the first accommodating portion.

In accordance with an embodiment, the butting part is fixed at the open end of the first accommodating portion by tight fitting, locking or screwing.

In accordance with an embodiment, the starting switch structure further comprises a cover that is a hollow housing receiving the starting switch structure and covering the contact point.

In accordance with an embodiment, the starting switch structure further comprises a second spring having an end at the contact point apart from the first accommodating portion and the other end against a bottom surface of the cover.

Accordingly, the starting switch structure of the invention has the following advantages:

(1) It is easy to process the starting switch structure because the first and second accommodating portions can be formed from surfaces of the plunger piston at two opposite sides of the axis.

(2) In accordance with the starting switch structure, the butting portion, of the first accommodating portion, having a planar surface or a stepped blind hole having a planar surface can be formed by a drilling or milling machine. The head of the guide pin can also be formed with the planar surface configured to butt against the butting portion in a surface-to-surface type contact. Thereby, the guide pin can move smoothly and can be uniformly pressed when abutting against the plunger piston. A stability of the contact point contacting the first and second terminals can be enhanced and thus an adhesion created due to an unstable contact of the contact point can be avoided.

(3) After the excitation portion of the starting switch structure is finished being excited, in case that the contact point contacts the first and second terminals, the butting part fitting around the guide pin and with the plunger piston can push the head of the guide pin to move in the second direction. This ensures that the contact point separates from the first and second terminals, and the adhesion of the contact point can be reduced.

The accompanying drawings are included to provide a further understanding of the invention, and are incorporated as a part of this specification. The drawings illustrate embodiments of the invention and, together with the description, serve to explain the principles of the invention.

DETAILED DESCRIPTION OF THE INVENTION

Following illustration accompanying with figures is embodiments for describing a starting switch structure. In the following embodiments, same elements are indicated by same reference numbers.

Figure 1:
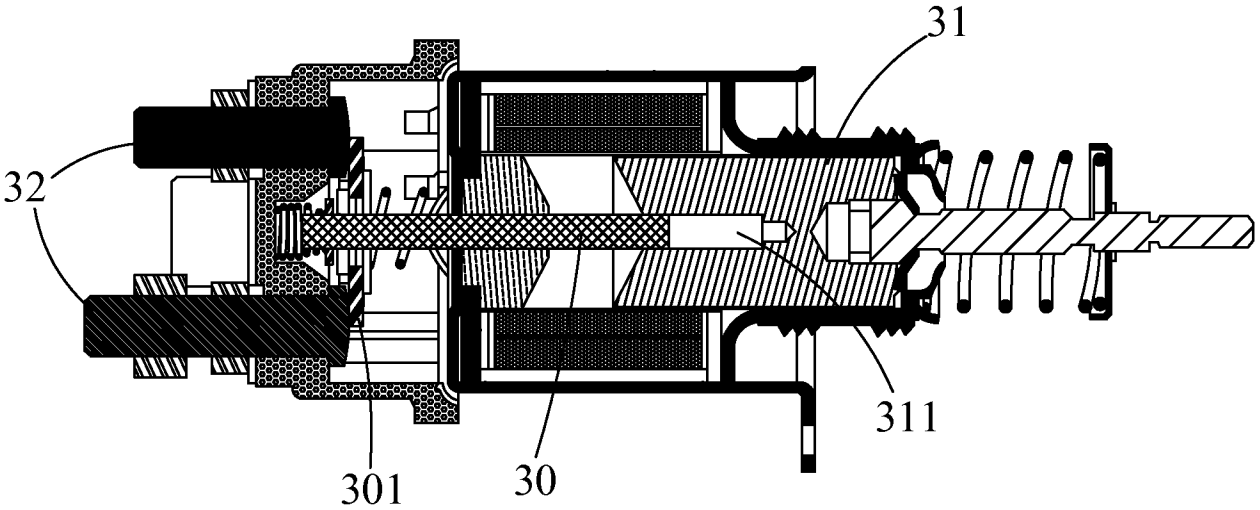
FIG. 1 (Prior Art)
FIG. 1 is a schematic view of prior art 1.
Figure 2:
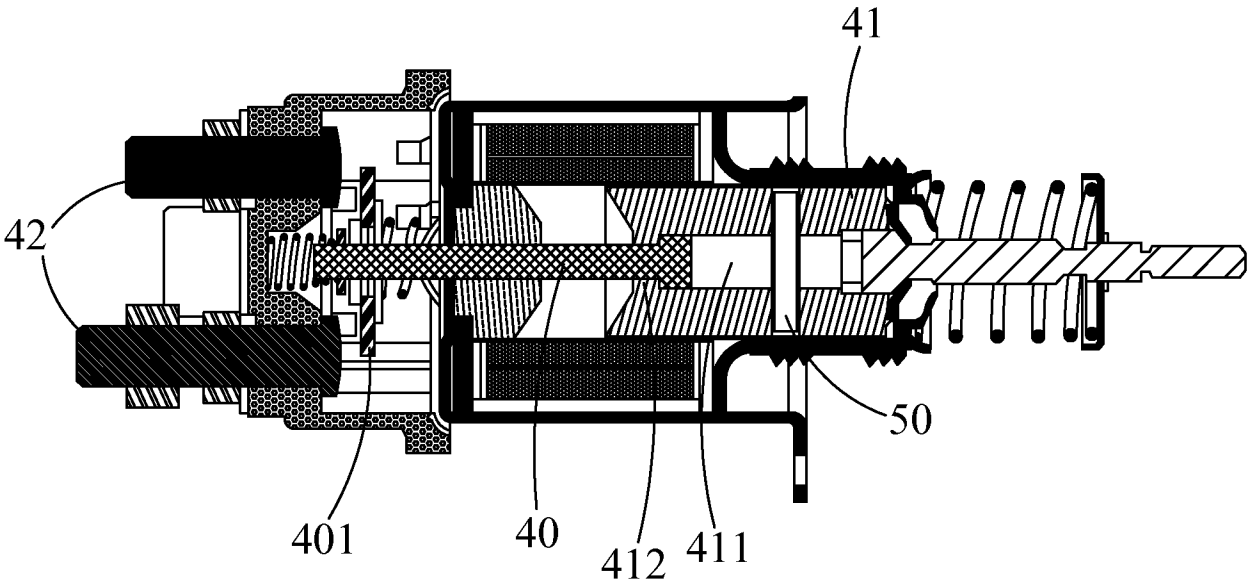
FIG. 2 (Prior Art)
FIG. 2 is a schematic view of prior art 2.
Figure 3:
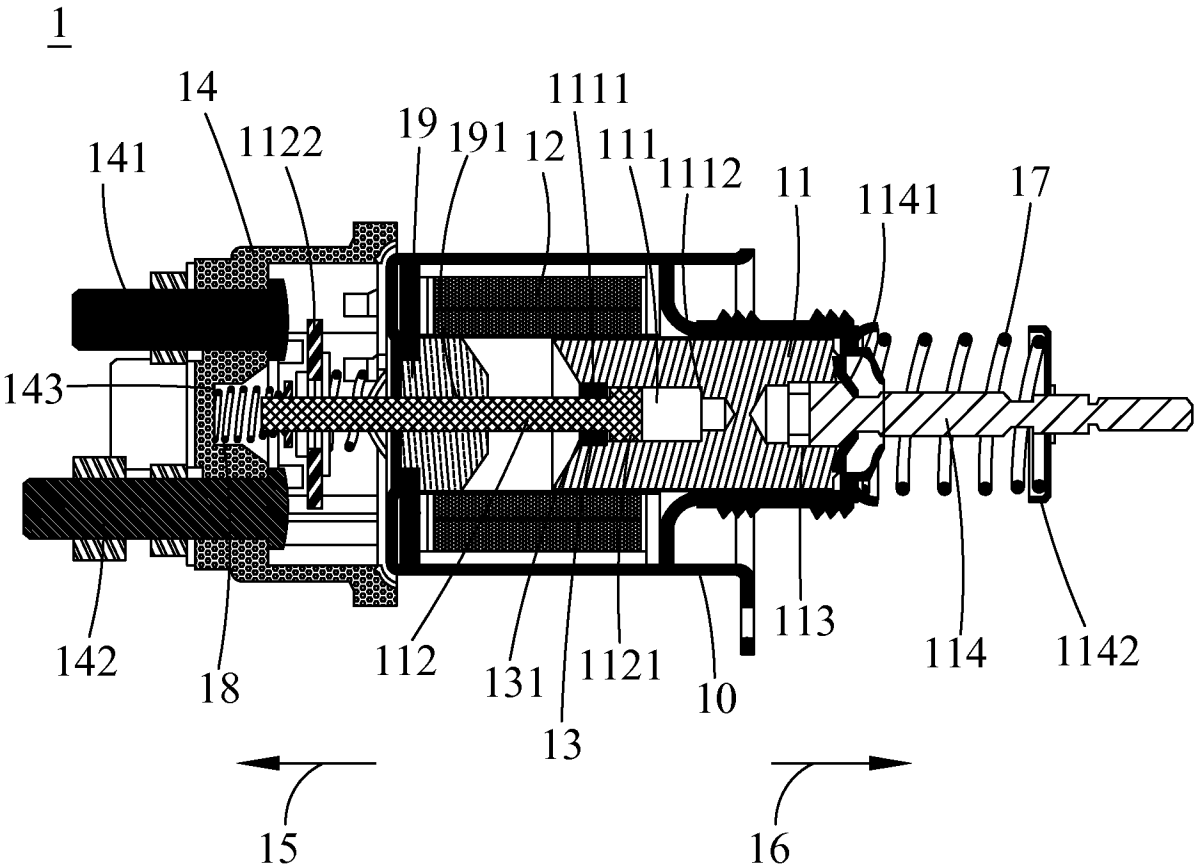
FIG. 3 is a schematic view of a starting switch structure in accordance with a first embodiment of the present invention.

FIG. 3 is a schematic view of a starting switch structure in accordance with a first embodiment of the present invention. Referring to FIG. 3, a starting switch structure 1 includes a body 10, a plunger piston 11, an excitation portion 12, a butting part 13 and a cover 14. The body 10 is a hollow housing. The plunger piston 11 is a cylinder movable in the body 10, wherein the plunger piston 11 has a first accommodating portion 111 at an end of an axis of the plunger piston 11, wherein the first accommodating portion 111 is provided with a blind hole for accommodating an end of a guide pin 112 reciprocally moving therein. The guide pin 112 is a cylinder having a head 1121 at the end thereof and in the first accommodating portion 111, wherein the head 1121 has a planar surface at an end thereof close to a bottom surface of the first accommodating portion 111. The guide pin 112 has a contact point 1122 at the other end thereof and outside the body 10. The first accommodating portion 111 has a butting portion 1112 at the bottom surface thereof, wherein the butting portion 1112 has a planar surface configured to make surface-to-surface type contact with the head 1121. The excitation portion 12 is wound in the body 10 and around the end of the plunger piston 11 arranged with the first accommodating portion 111. The butting part 13 is fixed at an open end 1111 of the first accommodating portion 111 of the plunger piston 11 by tight fitting, locking or screwing, wherein a first through hole 131 in the butting part 13 receives the guide pin 112. In the embodiment, tight fitting is employed as an example, but is not limited. The butting part 13 has a planar surface at a side thereof in the first accommodating portion 111. The cover 14 is a hollow housing receiving the body 10 and covering the contact point 1122, wherein a first terminal 141 and a second terminal 142 are arranged corresponding to the contact point 1122.

When the excitation portion 12 excites, the plunger piston 11 and the guide pin 112 move in a first direction 15 such that the contact point 1122 can contact the first and second terminals 141 and 142 and thus electrically connect the first terminal 141 to the second terminal 142. After the excitation portion 12 has finished exciting, the plunger piston 11 and the guide pin 112 move in a second direction 16 such that the contact point 1122 separates from the first and second terminals 141 and 142 and a broken circuit exists between the first terminal 141 and the second terminal 142.

The plunger piston 11 has a second accommodating portion 113 at the other end of the axis, wherein the second accommodating portion 113 can be provided with a blind hole accommodating an end of a cylindrical plunger piston rod 114. The cylindrical plunger piston rod 114 is fixed with the second accommodating portion 113 by a first fixing part 1141. The cylindrical plunger piston rod 114 has a second fixing part 1142 at the other end thereof. The starting switch structure 1 further contains a first spring 17 fitting around the cylindrical plunger piston rod 114, wherein the first spring 17 has an end against the body 10 and the other end against the second fixing part 1142. The first and second accommodating portions 111 and 113 can be formed by a drilling machine, a milling machine or drilling and milling machines, and thereby the butting portion 1112 can be formed with a planar surface. For example, a drilling machine can first be used to process. Next, a stepped blind hole can be formed with a planar surface by milling, or a surface can be milled by a milling machine. Besides, the starting switch structure 1 may contain a second spring 18 having an end at the contact point 1122 apart from the first accommodating portion 111 and the other end against a bottom surface 143 of the cover 14. The starting switch structure 1 further contains a pedestal 19 arranged in the body 10 and at an end of the body 10 apart from the plunger piston 11. A second through hole 191 in the pedestal 19 has a size corresponding to that of the guide pin 112. The guide pin 112 passes through the pedestal 19 through the second through hole 191, and the first accommodating portion 111 has a size allowing the head 1121 of the guide pin 112 to reciprocally move therein.

Figure 4:
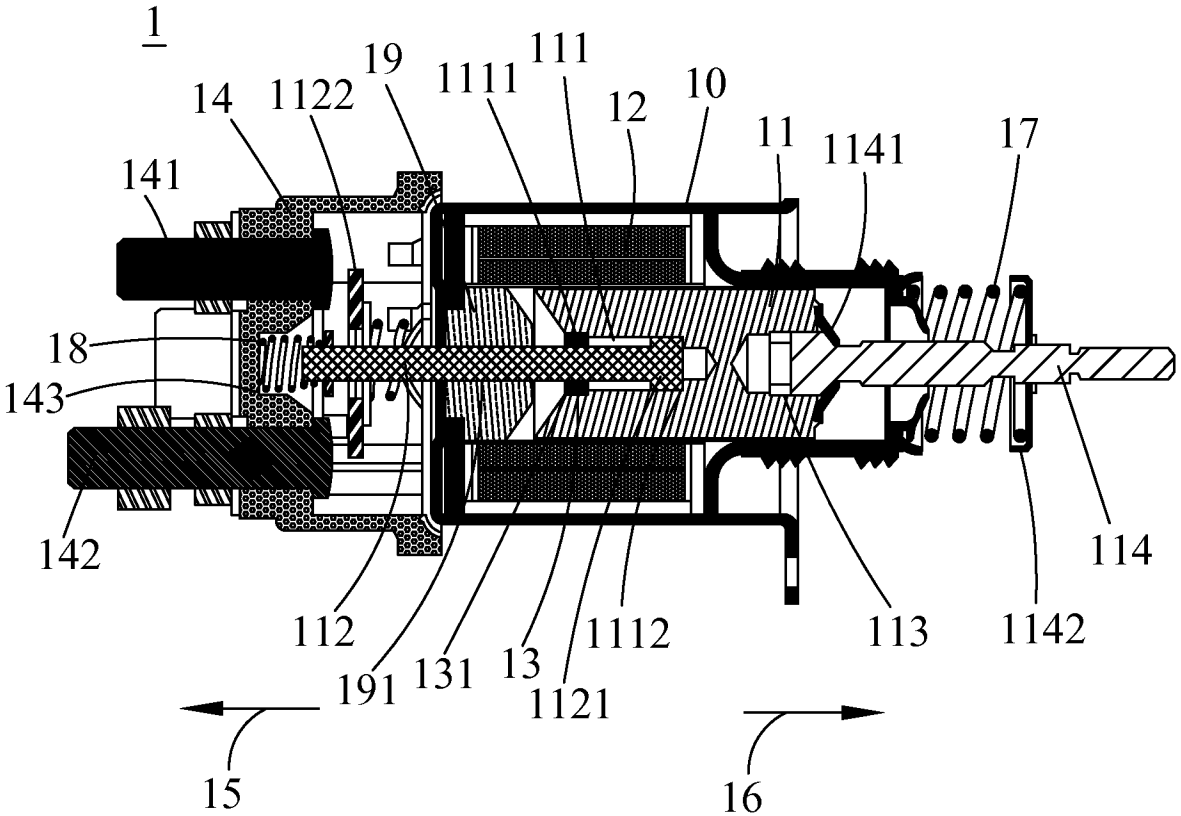
FIG. 4 is a schematic view of action 1 of a starting switch structure in accordance with a first embodiment of the present invention.
Figure 5:
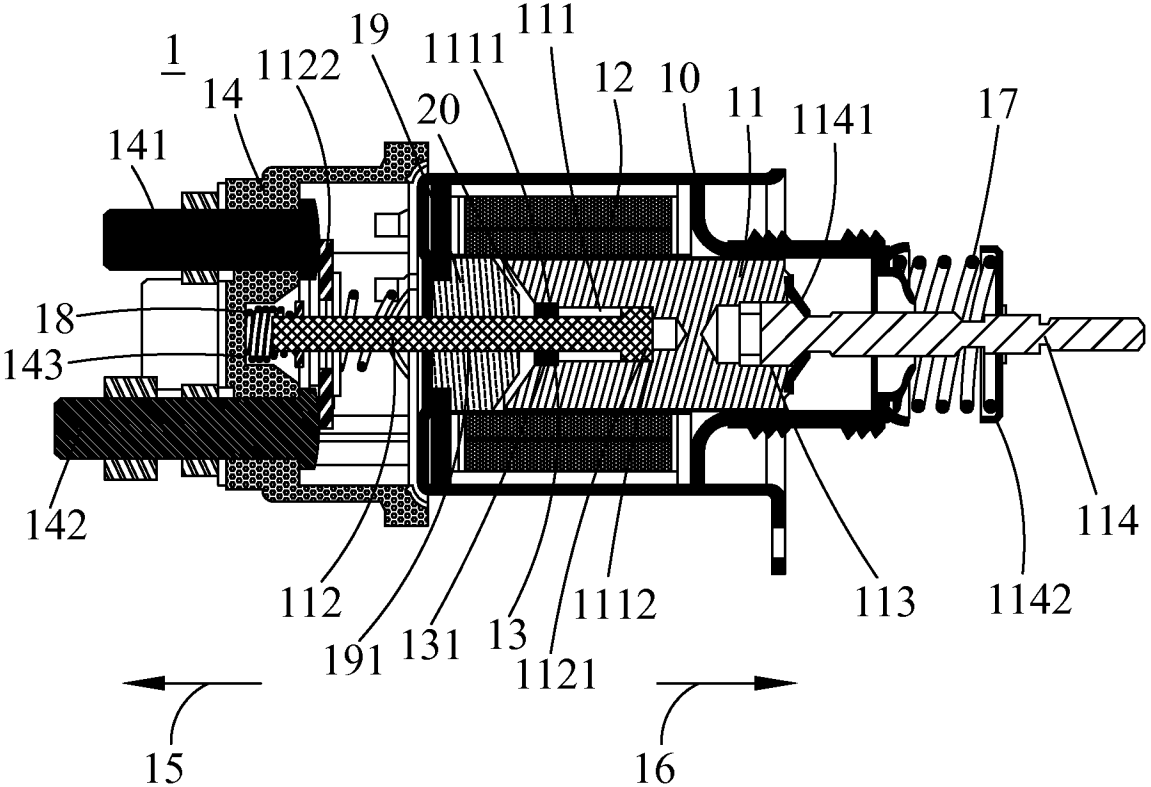
FIG. 5 is a schematic view of action 2 of a starting switch structure in accordance with a first embodiment of the present invention.
Figure 6:
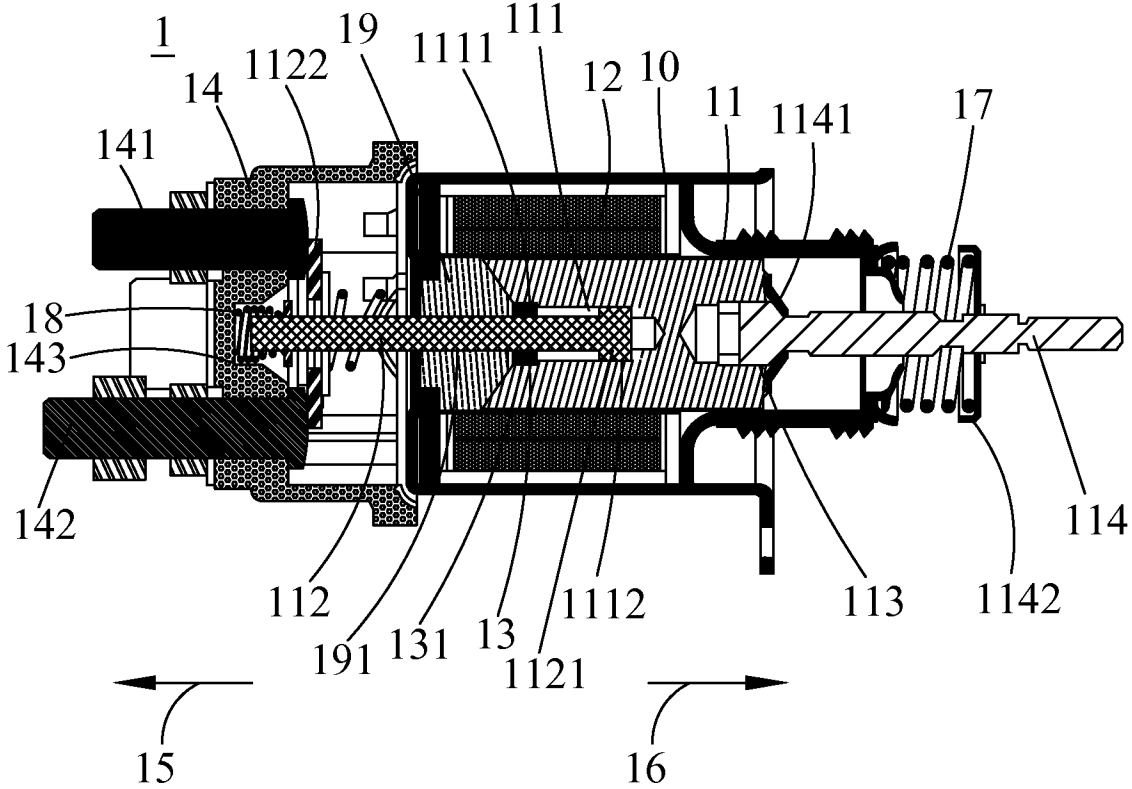
FIG. 6 is a schematic view of action 3 of a starting switch structure in accordance with a first embodiment of the present invention.

FIG. 4 is a schematic view of action 1 of a starting switch structure in accordance with a first embodiment of the present invention. FIG. 5 is a schematic view of action 2 of a starting switch structure in accordance with a first embodiment of the present invention. FIG. 6 is a schematic view of action 3 of a starting switch structure in accordance with a first embodiment of the present invention. Referring to FIGS. 4, 5 and 6, when the excitation portion 12 excites, the plunger piston 11 and the guide pin 112 are led to be sucked in the first direction 15, the second fixing part 1142 of the cylindrical plunger piston rod 114 presses the first spring 17, and the guide pin 112 presses the second spring 18 such that the contact point 1122 contacts the first and second terminals 141 and 142 and electrically connects the first terminal 141 to the second terminal 142 at the time when a secondary clearance 20 exists between the plunger piston 11 and the pedestal 19, as shown in FIG. 5, and the butting portion 1112 of the first accommodating portion 111 has the planar surface against the planar surface of the head 1121 of the guide pin 112. Next, the plunger piston 11 and the guide pin 112 continue to move in the first direction 15 such that the plunger piston 11 contacts the pedestal 19, as shown in FIG. 6.

After the excitation portion 12 has finished exciting, the plunger piston 11 and the guide pin 112 move in the second direction 16 by a resilient force of the first and second springs 17 and 18 such that the contact point 1122 separates from the first and second terminals 141 and 142 and a broken circuit exists between the first terminal 141 and the second terminal 142.

Figure 7:
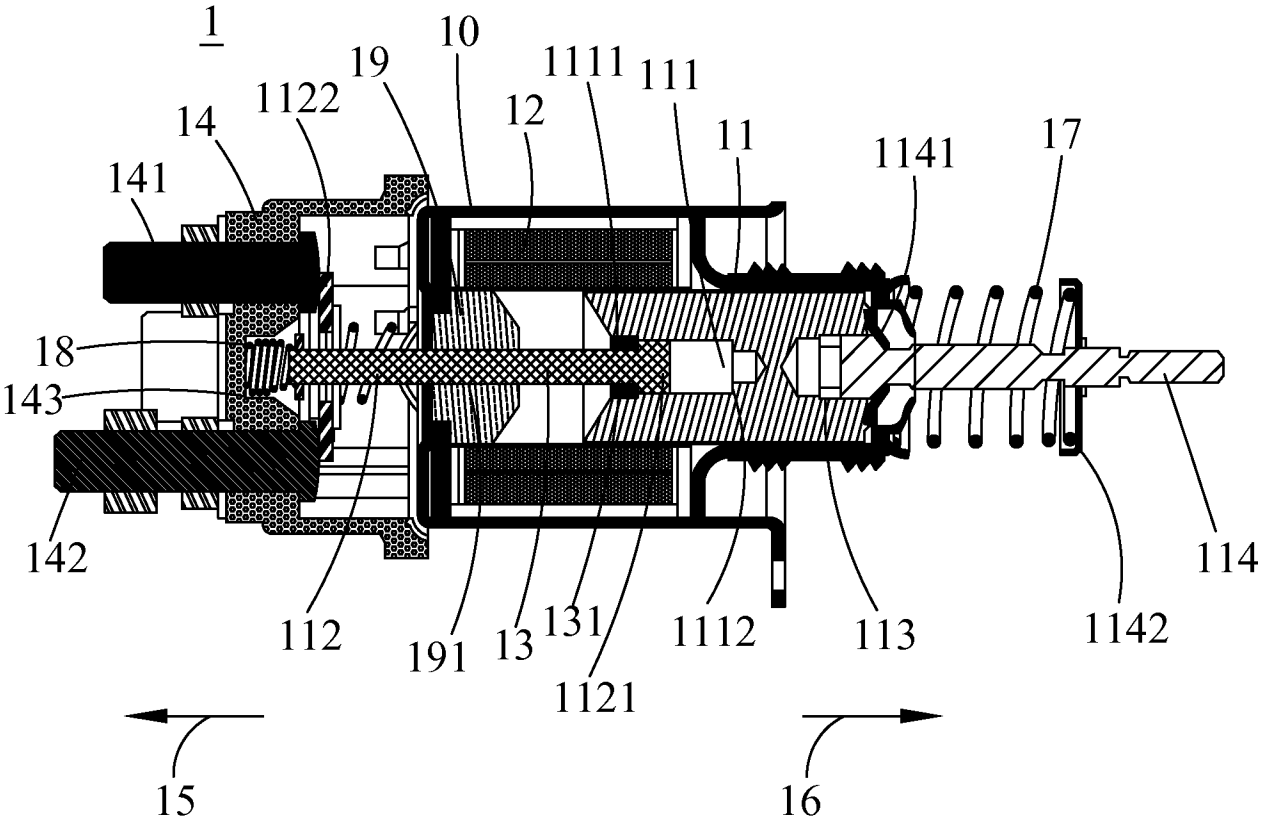
FIG. 7 is a schematic view of adhesion of a contact point of a starting switch structure in accordance with a first embodiment of the present invention.

FIG. 7 is a schematic view of adhesion of a contact point of a starting switch structure in accordance with a first embodiment of the present invention. Referring to FIG. 7, when the plunger piston 11 and the guide pin 112 move in the second direction 16, the contact point 1122 may be abnormally adhered to the first or second terminal 141 or 142. This leads to poor connection and poor operation and then the switch cannot operate easily such that it is possible for the starter to be burnt out due to running at idle. At this time, the butting part 13, fixed at the open end 1111 of the first accommodating portion 111, and the plunger piston 11 move in the second direction 16 simultaneously such that the butting part 13 has a surface close to the first accommodating portion 111, abutting against a surface close to the guide pin 112, of the head 1121 of the guide pin 112. This leads the contact point 1122 to separate from the first or second terminal 141 or 142 and thereby the starter can be prevented from being burnt out.

Figure 8:
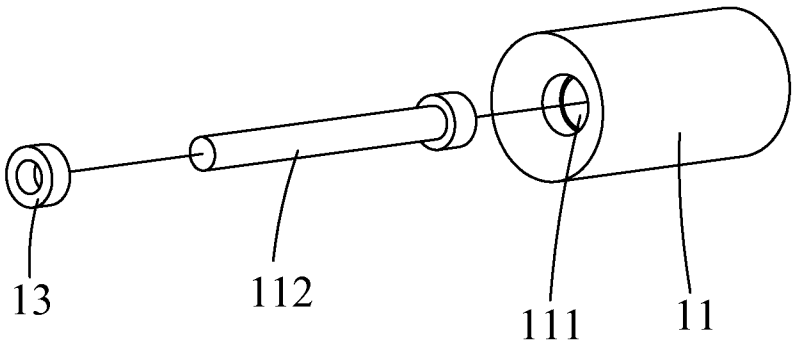
FIG. 8 is a schematic view of assembling a plunger piston, a guide pin and a butting part of a starting switch structure in accordance with a first embodiment of the present invention.

FIG. 8 is a schematic view of assembling a plunger piston, a guide pin and a butting part of a starting switch structure in accordance with a first embodiment of the present invention. Referring to FIG. 8, the head 1121 of the guide pin 112 is first fitted into the first accommodating portion 111 of the plunger piston 11. Next, the butting part 13 is fitted around the guide pin 112 and then tightly fitted into the open end 1111 of the first accommodating portion 111.

Figure 9:
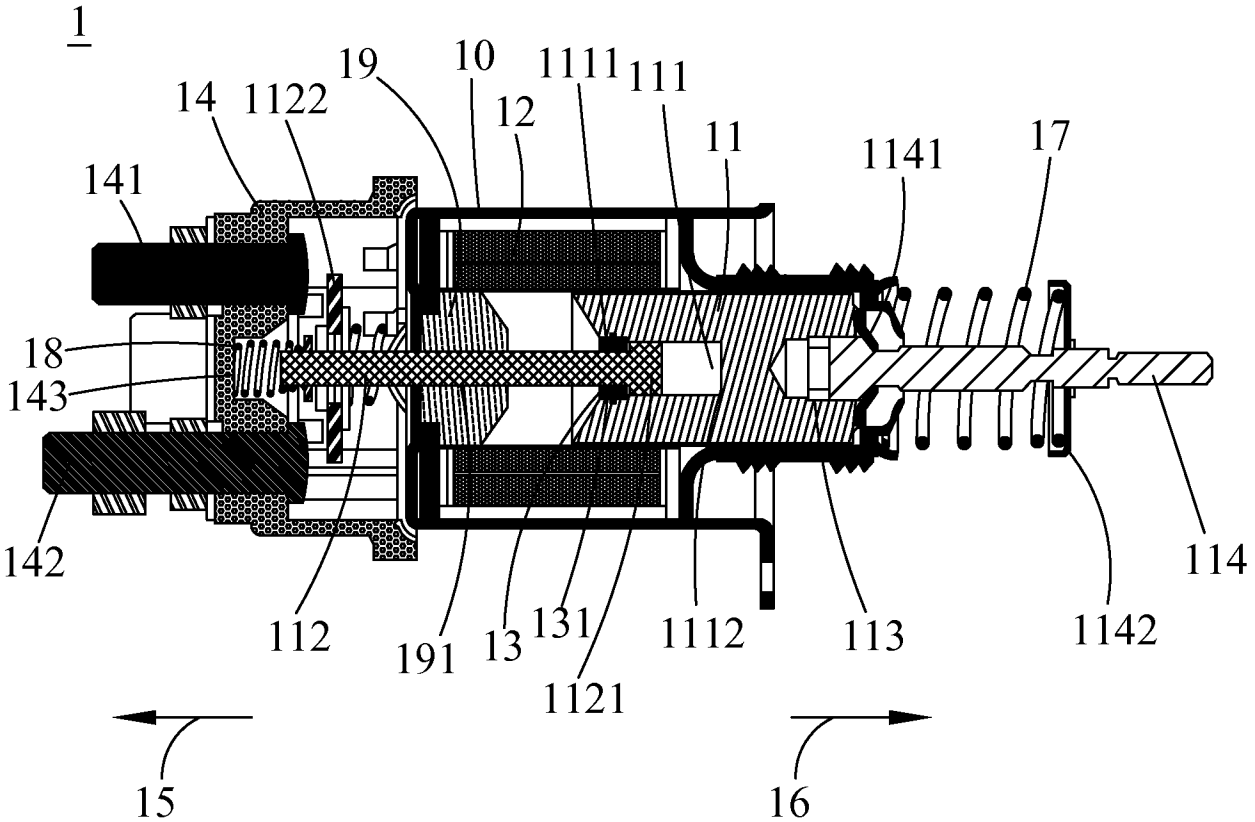
FIG. 9 is a schematic view of a starting switch structure in accordance with a second embodiment of the present invention.

FIG. 9 is a schematic view of a starting switch structure in accordance with a second embodiment of the present invention. Referring to FIG. 9, the starting switch structure 1 includes the body 10, the plunger piston 11, the excitation portion 12, the butting part 13 and the cover 14. The embodiment is similar to the first embodiment, and the difference there between is that the first accommodating portion 111 can be provided with a blind hole having a planar bottom surface formed by milling so as to form a butting portion 1112 contacting the head 1121 of the guide pin 112 in a surface-to-surface type contact and thus stably and uniformly butting against the head 1121. The first through hole 131 in the butting part 13 receives the guide pin 112, and the butting part 13 has a locking portion corresponding to a groove at the open end 1111 of the first accommodating portion 111 such that the butting part 13 can be fixed at the open end 1111 of the first accommodating portion 111 of the plunger piston 11 by locking.

Figure 10:
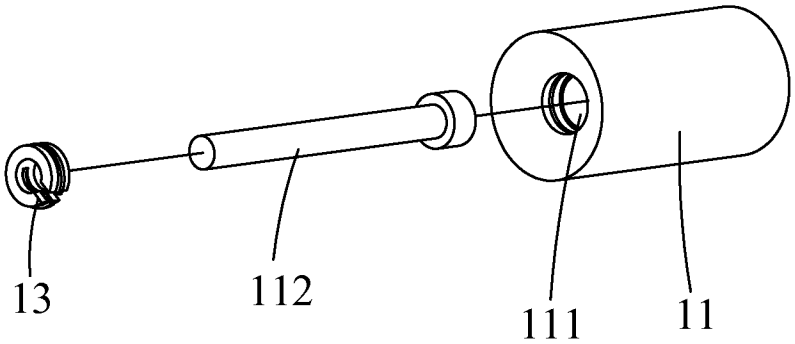
FIG. 10 is a schematic view of assembling a plunger piston, a guide pin and a butting part of a starting switch structure in accordance with a second embodiment of the present invention.

FIG. 10 is a schematic view of assembling a plunger piston, a guide pin and a butting part of a starting switch structure in accordance with a second embodiment of the present invention. Referring to FIG. 10, the head 1121 of the guide pin 112 is first fitted into the first accommodating portion 111 of the plunger piston 11. Next, the butting part 13 is fitted around the guide pin 112 and then locked at the open end 1111 of the first accommodating portion 111.

In the embodiment, except the above description, the arrangement for the other elements is similar to that illustrated in the first embodiment, and not repeated.

Figure 11:
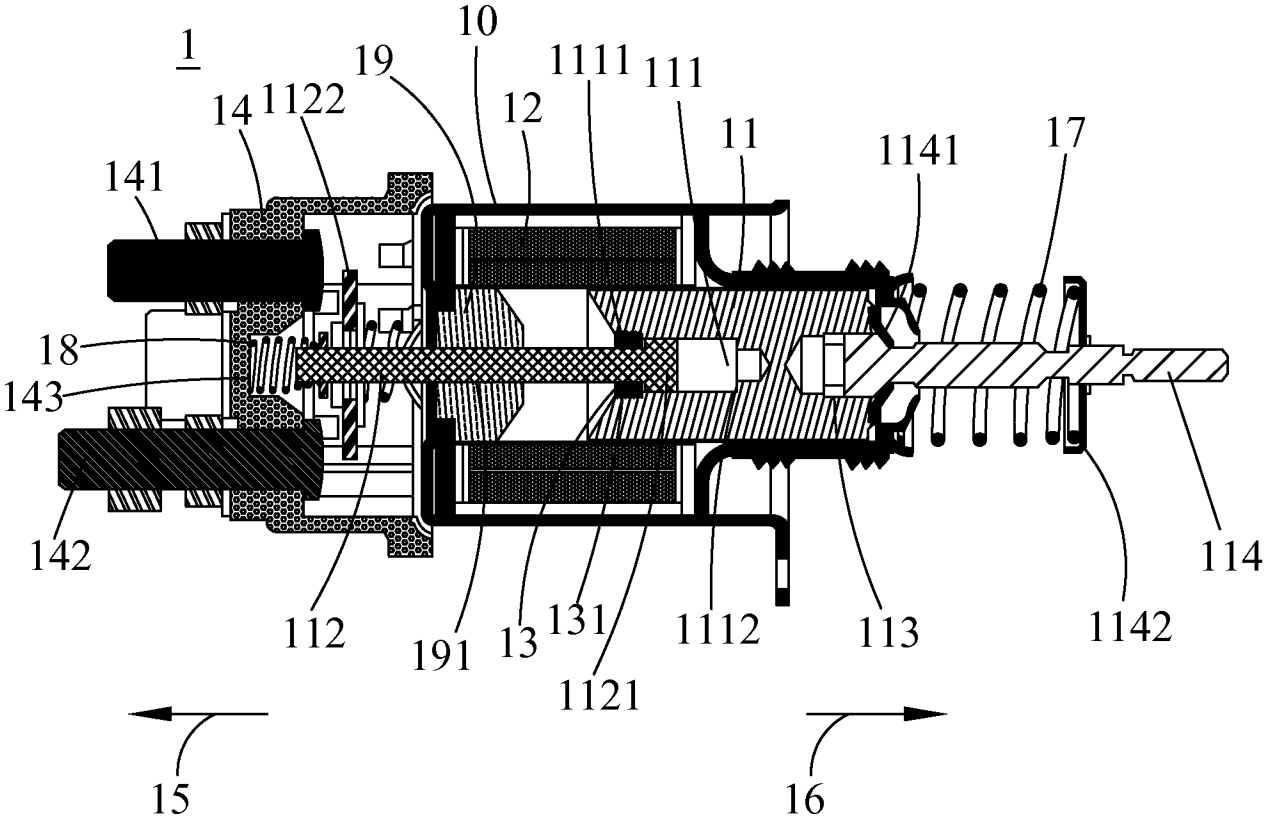
FIG. 11 is a schematic view of a starting switch structure in accordance with a third embodiment of the present invention.

FIG. 11 is a schematic view of a starting switch structure in accordance with a third embodiment of the present invention. Referring to FIG. 11, the starting switch structure 1 includes the body 10, the plunger piston 11, the excitation portion 12, the butting part 13 and the cover 14. The embodiment is similar to the first embodiment, and the difference there between is that the first through hole 131 in the butting part 13 receives the guide pin 112, and the butting part 13 has an outer thread at a sidewall thereof corresponding to an inner thread at the open end 1111 of the first accommodating portion 111 such that the butting part 13 can be fixed at the open end 1111 of the first accommodating portion 111 of the plunger piston 11 by screwing.

Figure 12:
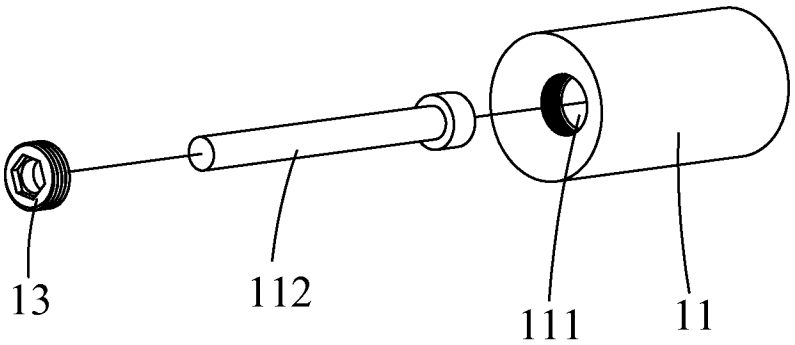
FIG. 12 is a schematic view of assembling a plunger piston, a guide pin and a butting part of a starting switch structure in accordance with a third embodiment of the present invention.

FIG. 12 is a schematic view of assembling a plunger piston, a guide pin and a butting part of a starting switch structure in accordance with a third embodiment of the present invention. Referring to FIG. 12, the butting part 13 has an outer thread at a periphery thereof, and an inner thread is formed at the open end 1111 of the first accommodating portion 111. The head 1121 of the guide pin 112 is first fitted into the first accommodating portion 111 of the plunger piston 11. Next, the butting part 13 is fitted around the guide pin 112 and then screwed at the open end 1111 of the first accommodating portion 111. Additional screws or adhesives can be employed to ensure to prevent the butting part 13 from falling off.

In the embodiment, except the above description, the arrangements for the other elements are similar to that illustrated in the first embodiment, and not repeated.

What is claimed is:

1. A starting switch structure comprising:

a body that is a hollow housing;

a plunger piston movable in the body, wherein the plunger piston has a first accommodating portion at an end of an axis of the plunger piston for accommodating an end of a guide pin reciprocally moving therein, wherein the guide pin has a head at the end thereof and in the first accommodating portion, wherein the head has a planar surface at an end thereof close to a bottom surface of the first accommodating portion, wherein the guide pin has a contact point at the other end thereof and outside the body, wherein the first accommodating portion has a butting portion, formed as a single piece with the plunger piston, at the bottom surface thereof, wherein the butting portion defines a ring-shaped planar surface perpendicular to the axis and is configured to make surface-to-surface type contact with the planar surface of the head;

an excitation portion wound in the body and around the end of the plunger piston arranged with the first accommodating portion, wherein the plunger piston and the guide pin move in a first direction when the excitation portion excites, while the plunger piston and the guide pin move in a second direction after the excitation portion has finished exciting;

a butting part being removable from the plunger piston and fixed at an open end of the first accommodating portion of the plunger piston, wherein a first through hole in the butting part receives the guide pin; and a cover that is a hollow housing for receiving the body and covering the contact point, wherein a first terminal and a second terminal are arranged corresponding to the contact point, wherein the contact point is led to contact the first and second terminals and thus electrically connect the first terminal to the second terminal when the plunger piston and the guide pin move in the first direction, while the contact point is led to separate from the first and second terminals such that a broken circuit is led between the first terminal and the second terminal when the plunger piston and the guide pin move in the second direction.

2. The starting switch structure of claim 1 further comprising a pedestal in the body and at an end of the body apart from the plunger piston, wherein in case that the excitation portion excites, the plunger piston is led to be sucked in the first direction such that the contact point contacts the first and second terminals at the time when a secondary clearance exists between the plunger piston and the pedestal, and then the plunger piston is led to contact the pedestal.

3. The starting switch structure of claim 2, wherein the butting portion butts against the guide pin so as to prevent the guide pin from moving in the first direction after the secondary clearance exists.

4. The starting switch structure of claim 2, wherein a second through hole in the pedestal has a size corresponding to that of the guide pin, wherein the guide pin passes through the pedestal through the second through hole.

5. The starting switch structure of claim 1, wherein the first accommodating portion has a size corresponding to that of the head.

6. The starting switch structure of claim 1, wherein the plunger piston has a second accommodating portion at the other end of the axis for accommodating an end of a plunger piston rod, wherein the plunger piston rod is fixed with the second accommodating portion by a first fixing part.

7. The starting switch structure of claim 6 further comprising a first spring fitting around the plunger piston rod, wherein the plunger piston rod has a second fixing part at the other end thereof, wherein the first spring has an end against the body and the other end against the second fixing part.

8. The starting switch structure of claim 1 further comprising a second spring having an end at the contact point and at a different side from the first accommodating portion and the other end against a bottom surface of the cover.

9. The starting switch structure of claim 1, wherein the butting part has a planar surface at a side thereof in the first accommodating portion.

10. The starting switch structure of claim 1, wherein the butting part is fixed at the open end of the first accommodating portion by tight fitting, locking or screwing.

11. A starting switch structure suitable for electrical connection of a contact point to first and second terminals, comprising:

an excitation portion receiving a current to excite;

a plunger piston excited by the excitation portion, wherein the plunger piston has a first accommodating portion at an end of an axis of the plunger piston, wherein the first accommodating portion has a butting portion, formed as a single piece with the plunger piston, at a bottom surface thereof, wherein the butting portion defines a ring-shaped planar surface perpendicular to the axis, wherein the first accommodating portion receives an end of a guide pin reciprocally moving therein, wherein the guide pin is excited by the excitation portion and has a head at the end thereof, wherein the head has a planar bottom surface at an end thereof close to the bottom surface of the first accommodating portion such that the butting portion makes surface-to-surface type contact with the planer bottom surface of the head, wherein the contact point is arranged at the other end of the guide pin and outside the starting switch structure, wherein the contact point is led to electrically connect to the first and second terminals when the plunger piston and the guide pin move in a first direction, while a broken circuit is led between the first terminal and the second terminal when the plunger piston and the guide pin move in a second direction; and a butting part removably fixed at an open end of the first accommodating portion of the plunger piston.

12. The starting switch structure of claim 11, wherein the head of the guide pin is constrained in the first accommodating portion by the butting part and the bottom surface of the first accommodating portion of the plunger piston.

13. The starting switch structure of claim 11, wherein a first through hole in the butting part receives the guide pin.

14. The starting switch structure of claim 11, wherein the butting part has a planar surface at a side of an inner space of the first accommodating portion.

15. The starting switch structure of claim 11, wherein the butting part is fixed at the open end of the first accommodating portion by tight fitting, locking or screwing.

16. The starting switch structure of claim 11, wherein the plunger piston has a second accommodating portion at the other end of the axis for accommodating an end of a plunger piston rod, wherein the plunger piston rod is fixed with the second accommodating portion by a first fixing part.

17. The starting switch structure of claim 16 further comprising a first spring fitting around the plunger piston rod, wherein the plunger piston rod has a second fixing part at the other end thereof, wherein the first spring has an end against the starting switch structure and the other end against the second fixing part.

18. The starting switch structure of claim 11 further comprising a cover that is a hollow housing receiving the starting switch structure and covering the contact point.

19. The starting switch structure of claim 18 further comprising a second spring having an end at the contact point and at a different side from the first accommodating portion and the other end against a bottom surface of the cover.

* * * * *